US010427398B2

(12) United States Patent
Booth et al.

(10) Patent No.: US 10,427,398 B2
(45) Date of Patent: Oct. 1, 2019

(54) SECURITY PRINTING PRESS HAVING AT LEAST ONE PRINTING ASSEMBLY, AND METHOD FOR OPERATING A SQUEEGEE DEVICE

(71) Applicant: KOENIG & BAUER AG, Würzburg (DE)

(72) Inventors: Bradley Booth, Melbourne (AU); Matthias Gygi, Schmitten (CH); Volkmar Schwitzky, Würzburg (DE); Manfred Stöhr, Güntersleben (DE)

(73) Assignee: Koenig & Bauer AG, Wurzbug (DE)

( * ) Notice: Subject to any disclaimer, the term of this patent is extended or adjusted under 35 U.S.C. 154(b) by 115 days.

(21) Appl. No.: 15/538,214

(22) PCT Filed: Dec. 9, 2015

(86) PCT No.: PCT/EP2015/079126

§ 371 (c)(1),
(2) Date: Jun. 21, 2017

(87) PCT Pub. No.: WO2016/102187

PCT Pub. Date: Jun. 30, 2016

(65) Prior Publication Data

US 2017/0348963 A1 Dec. 7, 2017

(30) Foreign Application Priority Data

Dec. 22, 2014 (DE) ..... 10 2014 226 869

(51) Int. Cl.
*B41F 15/44* (2006.01)
*B41F 15/08* (2006.01)
(Continued)

(52) U.S. Cl.
CPC ..... *B41F 15/44* (2013.01); *B41F 15/0809* (2013.01); *B41F 15/0836* (2013.01);
(Continued)

(58) Field of Classification Search
CPC ..... B41F 15/42; B41F 15/44; B41F 15/0809; B41F 15/0836; B41F 15/423; B41F 15/34;
(Continued)

(56) References Cited

U.S. PATENT DOCUMENTS 3,990,363 A 11/1976 Vertegaal
5,671,671 A 9/1997 Wyssmann
(Continued)

FOREIGN PATENT DOCUMENTS

DE 102012002848 A1 8/2013
EP 723864 B1 8/1998
(Continued)

OTHER PUBLICATIONS

Aug. 20, 2018 Office Action issued in Japanese Patent Application No. 2017-533872.
(Continued)

*Primary Examiner* — David H Banh
(74) *Attorney, Agent, or Firm* — Mattingly & Malur, PC

(57) ABSTRACT

A squeegee device for a printing press, which prints a printing material, at at least one printing point, in accordance with a screen printing process, comprises a screen printing screen, a squeegee which is one of set against the screen printing screen in a thrown-on position and can be set against the screen printing screen In a thrown-on position, a bearing device which makes a throwing-on and throwing-off movement possible between the thrown-on position of the squeegee and a thrown-off position, and a drive device, by the use of which, the squeegee can be set against the screen printing screen and can be set away from the latter during operation in a manner which is correlated to a press or printing material phase position. The drive device is set up to one of bring about and to make possible throwing-on and
(Continued)

throwing-off of the squeegee in sequences which differ from one another in one of different positions and the phase lengths in relation to the length of the screen printing screen.

15 Claims, 11 Drawing Sheets

(51) Int. Cl.
*B41F 15/42* (2006.01)
*B41F 15/34* (2006.01)

(52) U.S. Cl.
CPC ..... *B41F 15/42* (2013.01); *B41F 15/423* (2013.01); *B41F 15/34* (2013.01)

(58) Field of Classification Search
CPC ..... B41L 13/04; B41L 13/06; B41L 13/1318; B41L 13/18
See application file for complete search history.

(56) References Cited

U.S. PATENT DOCUMENTS

| | | | | |
|---|---|---|---|---|
| 7,287,467 | B2 | 10/2007 | Stohr | |
| 7,458,319 | B2 | 12/2008 | Stöhr | |
| 8,499,687 | B2 | 8/2013 | Gygi et al. | |
| 8,813,644 | B2 | 8/2014 | Gygi et al. | |
| 2005/0199146 | A1* | 9/2005 | Kusaka | B41F 15/0809 101/409 |
| 2007/0119316 | A1* | 5/2007 | Sugiyama | B41F 11/00 101/216 |
| 2008/0307987 | A1 | 12/2008 | Umetsu et al. | |
| 2009/0000497 | A1* | 1/2009 | Umetsu | B41F 15/0809 101/120 |
| 2010/0242753 | A1 | 9/2010 | Gygi | |
| 2012/0204744 | A1 | 8/2012 | Glöckner | |
| 2014/0047991 | A1* | 2/2014 | Kusaka | B41F 31/22 101/123 |
| 2015/0075396 | A1* | 3/2015 | Kusaka | B41F 15/0809 101/116 |

FOREIGN PATENT DOCUMENTS

| | | | |
|---|---|---|---|
| EP | 1246726 | B1 | 7/2003 |
| EP | 1724113 | B1 | 11/2006 |
| EP | 2014466 | A2 | 1/2009 |
| EP | 2025515 | A1 | 2/2009 |
| JP | H08-230149 | A | 9/1996 |
| JP | 2001-519263 | A | 10/2001 |
| JP | 2009-018565 | A | 1/2009 |
| JP | 2010-536602 | A | 12/2010 |
| WO | 01/026904 | A1 | 4/2001 |
| WO | 2003/093013 | A2 | 11/2003 |
| WO | 2008/102303 | A2 | 8/2008 |
| WO | 2011/018243 | A1 | 2/2011 |

OTHER PUBLICATIONS

International Search Report of PCT/EP2015/079126 dated Mar. 10, 2016.

* cited by examiner a)

b)

SECURITY PRINTING PRESS HAVING AT LEAST ONE PRINTING ASSEMBLY, AND METHOD FOR OPERATING A SQUEEGEE DEVICE

CROSS-REFERENCE TO RELATED APPLICATIONS

This application is the U.S. National phase, under 35 U.S.C. § 371, of PCT/EP2015/079126, filed Dec. 9, 2015; published as WO2016/102187A1 on Jun. 30, 2016 and claiming priority to DE 10 2014 226 869.9, filed Dec. 22, 2014, the disclosures of which are expressly incorporated herein by reference.

FIELD OF THE INVENTION

The present invention relates to a security printing press having at least one printing assembly, and a method for operating a squeegee device. The security printing press has at least one printing assembly and includes a printing unit by the use of which, a sheet-type printing substrate can be printed on in accordance with a screen printing method, at least at one printing point which is formed between a screen cylinder and an impression cylinder. One or more drying units is or are located on a printing substrate path and are disposed downstream of the printing assembly. A squeegee device is also part of the printing unit and includes a screen printing forme, a squeegee which is set against a screen printing forme in a thrown on position or which can be set against the screen printing forme in a thrown on position; a bearing device which enables a throwing-on and throwing-off movement between the thrown-on position of the squeegee and a thrown-off position and a drive device by the use of which, the squeegee can be thrown onto and off of the screen printing forme during operation, in a manner which is correlated to a press or printing substrate phase position. For a longer printing substrate format, as viewed in a transport direction of the printing substrate, the squeegee is placed in the thrown-on position for a greater phase length than for a shorter printing substrate format. For a greater print image length, as viewed in the transport direction of the printing substrate, the squeegee is placed in the thrown-on position for a greater phase length than for a shorter print image length. For a greater printing strip width, as viewed in the transport direction of the printing substrate, the squeegee is placed in the thrown-on position for a greater phase length than for a shorter printing strip width.

BACKGROUND OF THE INVENTION

EP 0723864 A1 discloses a rotary screen printing press having a screen cylinder that forms a printing nip with an impression cylinder. On its circumferential surface, the impression cylinder comprises cylinder pits, in which gripper devices are held for the purpose of sheet transport. To prevent the screen printing stencils from becoming damaged as they roll over the pits, the squeegee, which is otherwise set against the inside of the screen printing stencil, is lifted off by means of an actuating mechanism to an idle position for the duration of passage through the nip, relieving the pressure as the pit passes through the nip. The squeegee is thrown off in this case by a cam roller rolling along a cam disk, counter to the action of an actuating cylinder that is loaded by a constant force. To enable the squeegee to be replaced quickly, thereby allowing printing to recommence soon after the passage of a pit, a covering that can optionally be moved to cover the pit can be provided. In this way, the squeegee can be thrown on, thereby allowing the necessary ink bead to be formed even before the end of the channel has been passed.

EP 1246726 B1 discloses a printing press having a printing screen and having a squeegee, which can be thrown onto said screen and which, to carry out the actuating movement, is mounted on a squeegee receiver that is rigidly connected to the press frame so as to permit only translational movement. Throwing on and off can be actuated, for example, hydraulically, pneumatically or electromagnetically, but is preferably achieved by means of a cam disk.

EP 1724113 B1 discloses a bearing device for a cylindrical screen of a screen printing unit, in which the cylindrical screen is supported at both ends in independently axially movable holders. Eccentric bearings disposed at both ends can be used to adjust the axial distance from an impression cylinder, and an additional eccentric bearing at one of the ends can also be used to adjust the axial inclination. The circumferential position relative to the impression cylinder can be varied by means of an axially movable helical gear in the drive train. A squeegee holder that extends inside the screen cylinder and supports a squeegee can be moved diametrically relative to the frame by a pneumatic mechanism.

WO 03/093013 A2 discloses a screen printing press having a screen cylinder, in which a screen, which is cylindrical in the mounted state, is detachably attached by ring flanges at the end face.

WO 2008/102303 A2 discloses a screen printing press having a device for producing oriented magnetic field lines on the printing substrate.

EP 2025515 A1 discloses a security printing press having at least one printing assembly with a printing unit, by means of which a sheet-type printing substrate can be printed on in a screen printing process, at least at one printing point formed between a screen cylinder and an impression cylinder, with one or more drying units on a printing substrate path disposed downstream of the printing assembly, and with an additional drying unit, which is provided between the at least one printing point and a point downstream in the printing substrate path, at which the side of the printing substrate that has been printed by the printing point comes in physical contact with a succeeding rotary body. A squeegee that is part of the printing unit can be thrown onto and off of the screen printing forme in a manner which is correlated to a press or printing substrate phase position.

EP 2014466 A2 discloses a squeegee device of a screen printing unit, which is thrown off dependent on a printing substrate length or printing length. The squeegee is thrown off upstream of the trailing end of the sheet to relieve a certain amount of pressure on the screen before the mechanical load as the sheet rolls along the screen on the lateral surface of the cylinder.

SUMMARY OF THE INVENTION

The object of the present invention is to devise a security printing press having at least one printing assembly, and a method for operating a squeegee device.

The object is achieved according to the present invention by the provision of an inking aid, by the use of which, an opening of a pit, which is located on a lateral surface of the impression cylinder and comprising a retaining device for printing substrate sheets, can be at least partially covered, at least temporarily, at least in the trailing area of the opening. The drive control includes a drive assembly which can be controlled by a control device and by the use of which the throwing-on and throwing-off movement of the squeegee can be brought about mechanically independently of the press or printing substrate phase position. The drive device is configured to bring about or to enable throwing-on and throwing-off of the squeegee in sequences that are different from one another, with phase positions or phase lengths that are different from the in relation to the length of the screen printing forme.

The advantages to be achieved with the invention are, in particular, that improved print quality and/or less wear during printing and/or reduced maintenance and cleaning effort can be achieved. In particular, by maintaining high print quality and/or less wear and/or reduced maintenance and cleaning effort, in one advantageous embodiment or operating mode, a variable format and/or print image length can be achieved, and in another embodiment or operating mode, the printing of print image elements that are separated by sections that will not be printed on is enabled.

In an embodiment of a squeegee device that is particularly preferred in terms of achieving the stated advantages, said squeegee device comprises a squeegee which, in a thrown-on position—in particular on a side of the screen printing forme that is opposite the printing point—can be set against said screen printing forme, in particular from the inside against a screen printing forme of a screen printing cylinder, a bearing device that enables a throwing-on and throwing-off movement between the thrown-on position of the squeegee and a thrown-off position, and a drive device, by means of which the squeegee, in particular the squeegee edge thereof, can be thrown onto and off of the screen printing forme during operation—for example directly or indirectly—in a manner which is correlated, in particular synchronized, to a press and/or printing substrate phase position. The drive device is configured—in particular with control and drive means configured appropriately and equipped for this purpose—to bring about a throwing on and throwing off of the squeegee in sequences that are different from one another, with different phase positions and/or phase lengths in relation to the length of the screen printing forme, in particular in relation to the inner circumferential surface of the screen printing forme of a screen printing cylinder. In particular, the drive device is configured to bring about a throwing on and throwing off of the squeegee with a phase position and/or phase length that is based on the current printing substrate format and/or print image.

The drive device preferably comprises a drive means that can be controlled by a control device and that can bring about the throwing-on and throwing-off movement mechanically independently of the press and/or printing substrate phase position. The control device is preferably a control device that is in signal communication with the drive means, and that throws the squeegee on and off with varying phase lengths and/or phase positions, dependent on the printing substrate format and/or dependent on information relating to the print image.

The advantages of a squeegee device of this type are particularly useful in connection with a printing press for printing on security paper, more particularly on sheets of security paper as the printing substrate.

Particularly in the case of security printing—for example in the production of securities—only small image elements that are spaced significantly from one another are printed at each printing point in a screen printing process, which entails the risk that non-printed points and/or the impression surface may become soiled with ink that also passes in minute volumes through areas of the screen not designated for printing. By throwing the squeegee off in said areas, this effect can be reduced or even prevented.

In a preferred method, during operation of the squeegee device a squeegee is thrown onto and thrown off of the screen printing forme, in particular an inner surface of a screen printing forme of a screen cylinder, in a recurring cycle comprising a sequence having one or more phases relating to the thrown-on position and one or more phases relating to the thrown-off position—in particular with respect to the position and/or length of the cycle—in correlation to a press and/or printing substrate phase length and/or position. To achieve one or more of the aforementioned advantages, the squeegee is thrown on and off according to a dependent sequence that is dependent on the printing substrate format and/or the print image. This means, for example, that a dependent sequence that is dependent on the printing substrate format and/or the print image is created and/or selected, according to which the throwing on and throwing off is then carried out during operation.

The squeegee is thus preferably thrown on and off—in particular within the cycle—dependent on the printing substrate format and/or the information relating to the print image, with varying phase lengths and/or phase positions.

The aforementioned preferred squeegee device and the features that refine the preferred method, as set forth below and/or in reference to the exemplary embodiments and/or in the features of the dependent claims, may be used individually or combined to form an advantageous refinement.

In a particularly advantageous refinement of the aforementioned solution, the position and/or length of the recurring throwing-on and throwing-off sequence can be synchronized overall to a master axis encoder. Alternatively or additionally, a cam mechanism driven by the drive means may be provided for implementing the on/off movement.

In an advantageous first operating mode, for a longer printing substrate format as viewed in the transport direction of the printing substrate, the squeegee is placed in the thrown-on position for a greater phase length than for a shorter printing substrate format. Instead, or as an alternative, in a second operating mode, for a greater print image length as viewed in the transport direction of the printing substrate, the squeegee is placed in the thrown-on position for a greater phase length than for a shorter print image length. Alternatively, in addition to or in place of the above, for a greater printing strip width, as viewed in the transport direction, of one of a plurality of printing strips, the squeegee can be placed in a thrown-on position for a greater phase length than for a narrower printing strip width.

BRIEF DESCRIPTION OF THE DRAWINGS

Exemplary embodiments of the invention are illustrated in the set of drawings and will be detailed in the following.

The drawings show.

DESCRIPTION OF THE PREFERRED EMBODIMENTS

Figure 1:
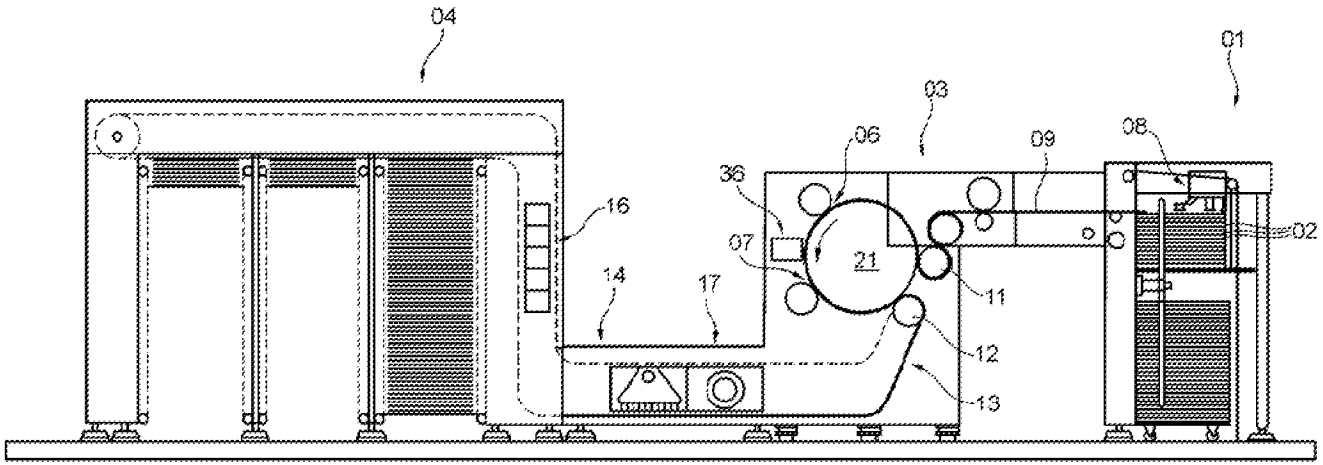
FIG. 1 an exemplary embodiment of a printing press comprising a printing assembly.

A printing press, for example a sheet-fed printing press or a web-fed printing press, comprises on the intake side an infeed device 01, which supplies the printing press with a sheet-type or web-type printing substrate 02, at least one printing assembly 03, with which the printing substrate 02 is imprinted one or more times on one side or both sides, and a product delivery unit 04, where printed products or intermediate products are delivered in stacks or continuously or are wound onto a roll (see, for example, FIG. 1).

In a preferred embodiment shown in the figures, the printing press is embodied as a printing press for the printing of securities, for example for printing on web-type printing substrate 02, for example a printing substrate web, or preferably for printing on sheet-type printing substrate 02, for example, printing substrate sheets 02. Infeed device 01 for the latter embodiment is configured, for example, as a sheet feeder 01, in which a stack of printing substrate sheets 02 to be fed in and printed can be held.

Printing assembly 03 of the printing press configured as a security printing press, for example, can be configured, in principle, as a printing assembly 03 that is based on any printing process having at least one printing point 06; 07, for example, as based on a gravure printing process, an offset process, a screen printing process, or a plurality of the aforementioned processes in succession. In the illustrated and preferred example, printing assembly 03 is configured to print on printing substrate 02 in the region of at least one printing point 06; 07 on at least one side of the printing substrate in a screen printing process, in particular in rotary screen printing. Printing substrate 02 to be printed on in the screen printing process is preferably embodied as printing substrate sheets 02 and/or as printing substrate 02 that has already been printed in a different printing process, and/or as, for example, security paper that contains textile, linen, hemp and/or synthetic fibers and/or as a plastic substrate (polymer substrate) or as a hybrid substrate.

The printing press is preferably embodied as a sheet-fed printing press for the printing of securities and is configured, for example, for printing on sheets of printing substrate 02 that are as yet unprinted or have already been printed on, to produce printed sheets, in particular sheets of securities, for example, sheets that contain banknotes, as products or as intermediate products to be further processed.

In this case, printing substrate sheets 02 are, for example, held in reserve as layers of a printing substrate stack in the infeed device 01 embodied as a sheet feeder 01, from which they are picked up individually, for example, by means of a gripper device 08 comprising suction cups, which is not shown in detail, and are conveyed separately along a conveyor line 09, for example, along a conveyor system 09, preferably configured as a belt system 09, and where appropriate an infeed drum, up to an intake region of printing assembly 03. At the intake into printing assembly 03, for example at a transfer drum 11, printing material sheet 02 is transferred to a conveyor line assigned to printing assembly 03, for example, a conveyor system assigned to printing assembly 03, along the transport path of which printing material sheet 02 passes through one or more printing points 06; 07 before entering a third conveyor line 13—for example, via a receiving drum 12—from the conveyor line assigned to printing assembly 03, or before being transferred to a third conveyor line 13, for example, a belt system 13, and transported by said conveyor line to product delivery unit 04, for example a product delivery unit 04 comprising one or more sheet delivery units for stacking.

In the case of a web-processing embodiment of the printing press, in the region of printing assembly 03 the web-type printing substrate 02 passes along a conveyor line that comprises one or more rollers and/or cylinders wrapped by the web.

In the preferred embodiment of the printing press as a sheet-processing printing press, the conveyor line assigned to printing assembly 03 is preferably configured as a gripper system, in which printing substrate sheet 02 is conveyed by successive transfers between a plurality of drums and/or cylinders in succession in the direction of transport along the transport path through printing assembly 03. At the end of the conveyor line configured, for example, as a gripper system, printing substrate sheet 02 is delivered to the third conveyor line 13.

In the printing substrate path downstream of printing assembly 03, one or more conditioning devices 14; 16; 17, for example one or more drying units 14; 16, for example, a first drying unit 14 and an additional drying unit 16, may be provided, and/or a device 17 for applying oriented magnetic field lines to printing substrate 02.

On at least one side of the conveyor line, printing assembly 03 comprises at least one printing point 06, by which one of the sides of printing substrate 02 is or can be imprinted. Printing point 06 can be formed by a nip point 06 between two rotary bodies 18; 21, for example, a nip point 06 between a cylinder 18 of a first printing unit 19 and a cylinder 21 that serves as the counter bearing for said cylinder 18, for example, an impression cylinder and/or transport cylinder 21.

Downstream of said at least one printing point 06, a first rotary body 22, which is situated downstream of printing point 06 in the printing substrate path and is in physical contact with the side of the printing substrate that has been imprinted by the at least one printing point 06, can be arranged in the printing substrate path of printing substrate 02, in particular in the conveyor line through printing assembly 03 that follows downstream of printing point 06. Said rotary body 22 that cooperates with the freshly printed side of the printing substrate may be embodied, for example, as a guide roller and/or transport roller in the conveyor system, as a conditioning roller for cooling or heating the printing substrate, or as a cylinder 22 of a printing unit 23 that follows the former printing unit 19, in particular so as to form an additional printing point 07.

A second printing point 07 of this type can be formed in this case by a nip point 07 between cylinder 22 of the second printing unit 23 and a cylinder that acts as a counter bearing, which is formed, for example, by the cylinder 21 that serves first printing unit 06 as an impression cylinder and/or transport cylinder 21, or by an additional cylinder, different therefrom, that acts as an impression cylinder and/or transport cylinder. One or more additional printing units of this type that act on this same side of the printing substrate, and/or one or more additional printing units that act on the other side of the printing substrate may also be provided upstream or downstream in the printing substrate path of the printing press and/or printing assembly 03.

In the preferred embodiment of the printing press as a sheet-processing printing press, the at least one impression cylinder and/or transport cylinder 21 comprises at least one retaining device 24 on its circumferential surface, for example, a gripper device 24 comprising one gripper or a group of multiple grippers, by means of which the leading end of a printing substrate sheet 02 can be picked up on the intake side and can be delivered to the conveyor line downstream on the output side. Gripper device 24 in this case is located, for example, in a pit 26 provided in the otherwise cylindrical lateral surface 27 of cylinder 21, with the radially outwardly directed opening 28 of said pit, for example, pit opening 28, interrupting and disrupting the cylindrical shell-shaped lateral surface 27.

Figure 2:
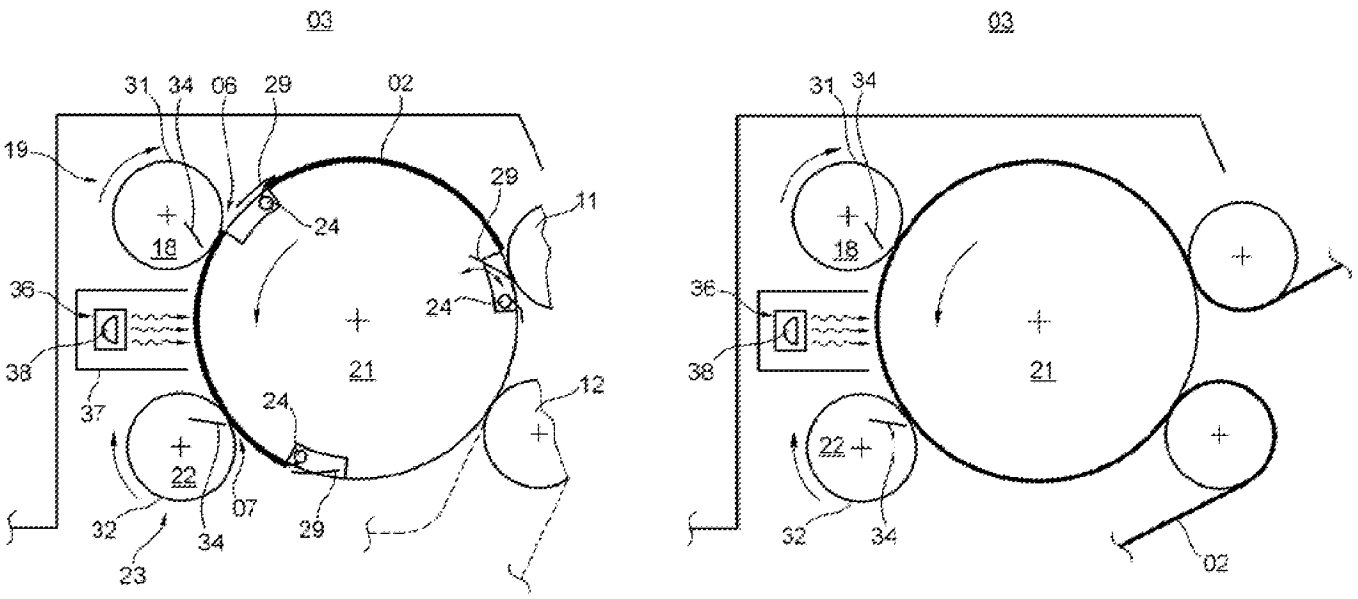
FIG. 2 an enlarged, detailed diagram of the exemplary embodiment of a printing assembly of FIG. 1 in a) a sheet processing embodiment and b) a web processing embodiment.

In an embodiment of impression cylinder and/or transport cylinder 21 that is configured to receive, for example, a number n ($n \in \mathbf{N}$) of printing substrate sheets 02, in this case, for example, n=3, one in front of the other in the circumferential direction, said cylinder comprises multiple retaining devices 24 of this type, i.e. n-fold, in this case, for example, three-fold, one in front of the other in the circumferential direction, and a cylindrical shell-shaped circumferential section lying between said devices in each case (see, for example, FIG. 2*a*). In the case of a web-processing embodiment of the printing press, such retaining devices can be dispensed with (see, for example, FIG. 2*b*). In more colloquial terms, the n-sized cylinder 21 comprises n copies, that is, n circumferential sections $U_D$ that can each be used without interruption for printing.

Regardless of the type and the number n of retaining devices 24 that are provided in the circumferential direction in the case of sheet printing, a break in the otherwise undisrupted, cylindrically shaped lateral surface 27 is caused by the respective pit opening 28 on the circumferential surface of the impression cylinder and/or transport cylinder 21.

In an n-sized, that is, a single-sized or multiple-sized embodiment, impression cylinder and/or transport cylinder 21, as viewed in the circumferential direction, comprises n, that is, one or more circumferential sections $U_D$, in particular cylindrical circumferential sections $U_D$, that can be used as a counter bearing during printing, and n, that is, one or more circumferential sections $U_N$ with a disrupted lateral surface 27, which comprise retaining devices 24 and cannot be used as a counter bearing during printing. In more colloquial terms, the circumferential sections $U_D$ that can be used as a counter bearing during printing are also referred to as "saddles".

The circumferential section $U_N$ that comprises opening 28 and is not suitable and/or intended for printing has an effective unrolled length $L_N$ along the continued circumferential line that is equivalent to the length of the arc that extends over the opening. The circumferential section $U_D$ that is usable for printing therefore has a length $L_D$ that at the same time limits the maximum potential length of the print image.

The circumferential section $U_N$ that cannot be used as a printing counter bearing may, in principle, be provided solely by opening 28 of pit 26 that accommodates retaining device 24, or if applicable, by said opening 28 and—if provided—a functional section that adjoins said opening on the leading and/or the trailing side, for example an overlap area of an inking aid 29 (see below), optionally provided on the leading side, and/or a spacing from the trailing edge of the pit opening that follows it, to be maintained by fixation. Conversely, the circumferential section $U_D$ that is usable for printing may be provided, in principle, by the cylindrical outer surface section between a leading end of the break 28, for example, the leading end of opening 28, and the leading end of the same opening or the next opening 28 that follows in the circumferential direction. If the contour that delimits the disruption in lateral surface 27 on the leading and/or the trailing side is irregular in configuration, the length $L_N$ of the circumferential section $U_N$ that cannot be used for printing is understood, for example, as the arc length, as viewed in the circumferential direction, between the first point on the leading side and the last point on the trailing side of the break 28 in the undisrupted lateral surface 27 caused by the same retaining device 24.

In an embodiment that is preferred here, the at least one printing unit 06, and in particular also the at least one additional printing unit 07 that cooperates with the same side of the printing substrate, is configured as a printing unit 06; 07 that operates according to the screen printing method, or more succinctly a screen printing unit 06; 07, and the cylinder 18; 22 assigned to printing unit 06; 07 is configured as a forme cylinder 18; 22, more particularly as what is known as a screen cylinder 18; 22.

Screen cylinder 18; 22 rolls along the lateral surface of the impression cylinder and/or transport cylinder 21, and forms printing point 06, 07 in the region of its aforementioned nip point 06; 07 with the impression cylinder and/or transport cylinder 21. In the region of its lateral surface, screen cylinder 18; 22 comprises a screen printing stencil 31; 32 as a printing forme 31; 32, arranged concentrically to the real or imaginary cylinder axis. In the mounted state, said stencil is releasably fastened at the end face, for example, to ring flanges, not shown in detail. Screen printing stencil 31; 32 can embodied, in principle, as a continuous screen printing stencil in the shape of a cylindrical shell or sleeve, or as a finite screen printing stencil 31; 32 which, in the mounted state, is nevertheless circumferentially closed, forming a small butt joint.

Figure 9:
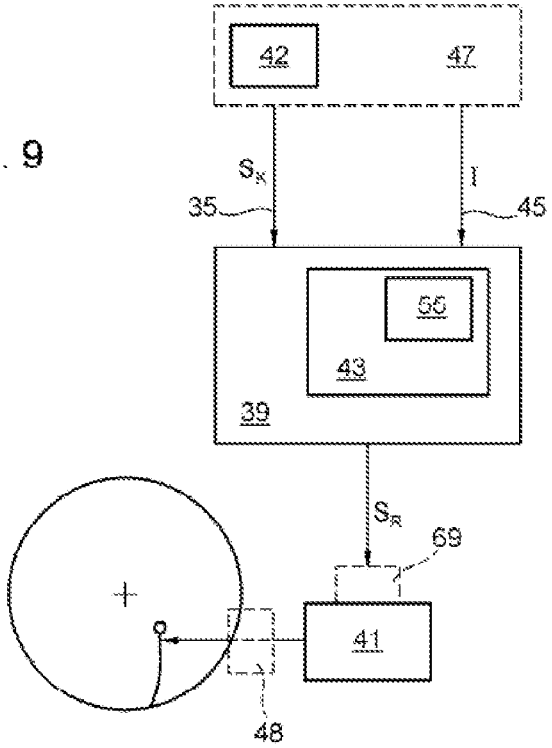
FIG. 9 a schematic diagram of a squeegee device comprising a drive device and a control device.

Inside forme cylinder 18; 22, a squeegee 34 of a squeegee device 33—illustrated schematically, for example, in FIG. 9—is provided, which in a thrown-on position "ON" is set against the screen printing stencil 31; 32 from the inside, in a circumferential region of screen cylinder 18; 22 in which said stencil forms printing point 06; 07 with the impression cylinder and/or transport cylinder 21. This point may be provided, for example, a maximum of 5° in front of or behind the nip point 06; 07 with impression cylinder and/or transport cylinder 21—in relation to the operational direction of rotation. When squeegee 34 is thrown on in this manner, it accumulates a bead of printing ink, which it rolls in front of itself and forces through the permeable areas of screen printing stencil 31; 32 toward the outside.

Once the aforementioned opening 28 in impression cylinder and/or transport cylinder 21 has passed through nip point 06; 07, in order to enable the quickest possible resumption of printing in the subsequent circumferential section $U_D$, for the temporary and at least partial covering of opening 28 an aforementioned inking aid 29, for example, a covering element 29 configured as a flap 29, may be provided, by means of which the opening 28 can be temporarily covered, at least in the trailing area of opening 28. This allows the squeegee 34, which is lifted off during the passage of the open region of opening 28 through the nip point, for example, to be thrown on in advance. Covering element 29 can overlap slightly with the undisrupted section of the cylindrical lateral surface, for example, and in that case shortens the length $L_D$ of the maximum circumferential section $U_D$ that is usable for printing. This geometric shortening is more than compensated for by throwing the squeegee on in advance, for example. By throwing the squeegee on in advance, a beginning of a printing area on the leading side—relative to rolling during operation—can ideally be immediately adjacent to covering element 29, but optionally also with a slight stand-off distance. The lengthening of the circumferential section $U_N$ that is not usable for printing beyond the leading edge of the opening, which results from the slight overlap, for example, and optionally from a slight stand-off distance following covering element 29, and/or the distance between the earliest possible beginning of the printing area and the trailing edge of the opening may be between 10 mm and 50 mm, for example, and is preferably no more than 30 mm.

Figure 3:
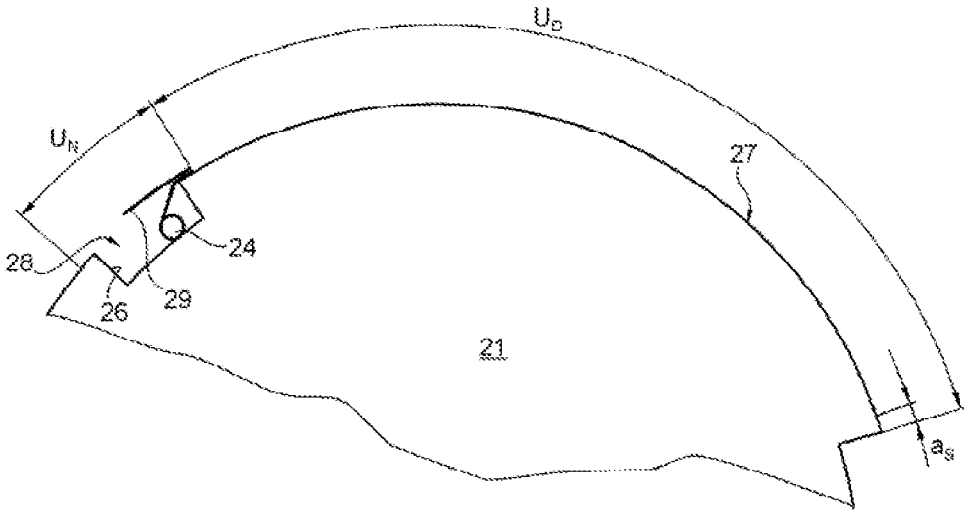
FIG. 3 a schematic cross-sectional diagram of an impression cylinder and/or transport cylinder segment.
Figure 4:
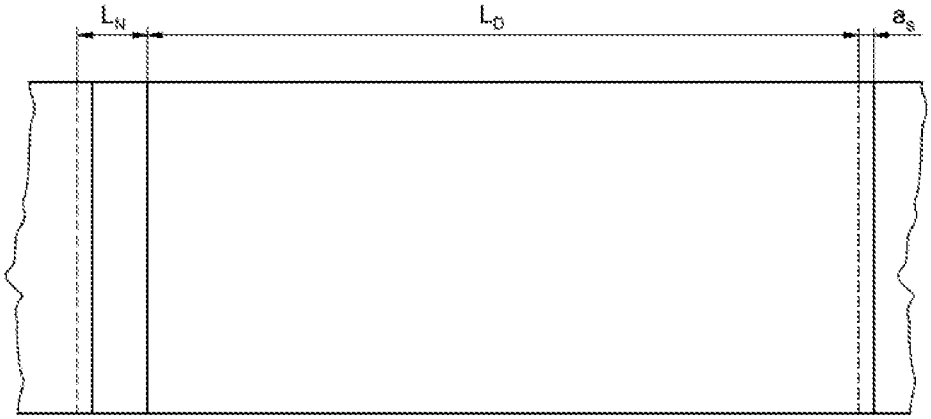
FIG. 4 a schematic diagram of an unrolled lateral surface segment of the impression cylinder and/or transport cylinder.

The maximum length $L_D$ that is usable for printing is limited by the earliest possible beginning of the printing area, determined by the press and/or safety considerations, and the latest possible end of the printing area on the trailing side, determined by the press and/or safety considerations. In principle, the latest possible end of the printing area may coincide with the leading end of the subsequent break 28, for example the leading opening edge of the subsequent break 28, or—for example, for reasons of safety and/or a risk of soiling and/or the length of a throwing-off phase $P_{off}$, mentioned below—may be spaced by a distance $a_S$ to be maintained from the trailing edge of the subsequent pit opening (see, for example, as schematically illustrated in FIG. 3 and FIG. 4). The maximum length $L_D$ that is usable for printing can be limited, for example, by the length of the undisrupted circumference of the counter bearing, for example, the impression cylinder and/or transport cylinder 21, or by other press elements that are involved in printing and/or transport, or by the maximum length that is usable for printing, as viewed in the transport direction and/or circumferential direction, of the printing formes 31; 32 provided for the printing unit 06; 07, in the following also referred to as the printing length. These sizes are regularly synchronized with one another and correspond substantially to one another.

In a single-sized embodiment of impression cylinder and/or transport cylinder 21, the succeeding pit opening is understood as the same single pit opening.

In the preferred embodiment, between the at least one printing point 06 and the point downstream in the printing substrate path at which the side of printing substrate 02 that has been printed on by printing point 06 comes in contact with the succeeding rotary body 22, an additional drying unit 36, for example, a dryer 36, in particular an intermediate dryer 36, is provided, which is preferably configured as a radiation dryer 36. To create an active zone for dryer 36 that is spatially confined along the printing substrate path, a shade 37 that restricts the radiation upstream and/or, in particular, downstream may be provided, said shade being provided, for example, by a wall 37 of a housing that accommodates dryer 36 and is open toward the side of the printing substrate. In the embodiment configured as a radiation dryer 36, the latter comprises an integral or multi-part radiation source 38 for electromagnetic radiation, for example, for light, in particular for UV light, in other words light for which at least the largest proportion of emitted radiant output lies in the UV spectral range. More particularly, dryer 36 may be embodied as a UV-LED dryer.

Squeegee device 33 (see, for example, FIG. 9, FIG. 11 and FIG. 12) comprises a bearing device 56, 57, 58 for squeegee 34 that enables a throwing-on and throwing-off movement, and a drive device 39, 41, 48, by means of which the squeegee edge of squeegee 34 is or can be thrown onto and off of screen printing stencil 31; 32 of screen printing cylinder 18; 22 in cyclic correlation, more particularly synchronized or clocked, during operation to the rotational position of impression cylinder and/or transport cylinder 21 and/or in cyclic correlation, in particular clocked, to the position of printing substrate 02 to be printed, as viewed in the transport direction—at least as said correlation relates to the length and/or position of a throwing-on and throwing-off sequence based on the cycle length $L_Z$, having at least one phase or sequence $P_{ON}$ relating to a thrown-on position "ON" and at least one phase or sequence $P_{OFF}$ relating to a thrown-off position "OFF". The correlation of the squeegee movement refers in general terms to a direct or indirect correlation to the press and/or printing substrate phase position, that is, for example, to the position and/or movement of a press phase, in particular to a phase position that relates to the printing point 06; 07, and/or to a position and/or an advancement of the printing substrate 02 in the printing press. This press phase can be determined by the directly or indirectly derived angular position of one of the cylinders 18; 21; 22 that forms the printing point 06; 07 in question. The variable that relates to the advancement of printing substrate 02 can be determined by an angular position signal of a press element that transports printing substrate 02 in a manner true to register or by a passage signal from a sensor system provided along the transport path.

Cycle length $L_Z$ is preferably determined by the repeat length between two successive print sections, that is, the shortest possible distance between the leading ends of two successive print image lengths. Depending on the physical variable in question, said variable may relate spatially to a path length between two sites y or to an angle Φ, or in temporal terms to the interval of time between two instants t. Factoring in the geometry and the conveying speed profile, these variables can then be converted to one another and related, for example, to a position relative to the press phase. Cycle length $L_Z$ is equal to the sum of the length L44 of a maximum section $U_D$ that is usable for printing, as viewed along the transport path, and the length $L_N$ of a section $U_N$ that lies between two such sections $U_D$ and is not usable for printing. In the case of sheet-fed printing, the latter may be dependent on the means for transporting sheets, for example, and in the case of web-fed printing, it may be dependent on breaks caused by butt joints or even gaps between the ends of mounted printing formes, for example. If an impression cylinder and/or transport cylinder 21 is provided, cycle length $L_Z$ is equal overall, for example, to the sum of the length L44 of a circumferential section $U_D$ that is usable for printing and the length $L_N$ of a circumferential section $U_N$ that is not usable for printing and/or the nth fraction of the circumference of the n-sized or n-saddle-comprising impression cylinder and/or transport cylinder 21.

A cycle length $L_Z$ of this type, or the throwing-on/off sequence associated with it, comprises, for example, at least one phase $P_{OFF}$ with squeegee 34 thrown off and at least one phase $P_{ON}$ with squeegee 34 thrown on. Here again, the term phase $P_{ON}$; $P_{OFF}$ may refer to a spatial or to a temporal variable. Such a cycle may comprise a sequence having only a single phase $P_{OFF}$ with squeegee 34 thrown off and one phase $P_{ON}$ with squeegee 34 thrown on, or in a refinement, may also comprise a sequence having a plurality of phases $P_{ON}$ with squeegee 34 thrown on, separated from one another in each case by a single phase $P_{OFF}$ with squeegee 34 thrown off. Due to the restricted speed of movement as squeegee 34 is being thrown on and off, a thrown-on phase $P_{on}$ or a thrown-off phase $P_{off}$ may be placed between the phase $P_{ON}$ during which squeegee 34 is thrown on in its actual working position, in which the squeegee is set, for example, not only directly up to screen printing stencil 31; 32, but with a slight deflection of, for example at least 0.5 mm, that is, a negative distance $a_{ON}$ of $a_{ON} \leq -0.5$ mm, determined by the measure of the actuating movement that exceeds initial physical contact, and the phase $P_{OFF}$ during which squeegee 34 is effectively thrown off, in which the squeegee edge is positioned a slight distance $a_{OFF}$ of, for example, $a_{OFF} \geq 0.2$ mm, in particular 1.2 mm$\geq a_{OFF} \geq 0.4$ mm, from screen printing stencil 31; 32.

To minimize the indistinct area between the actual thrown-on position "ON" and the actual thrown-off position "OFF" and/or the area that is not usable for printing, while nevertheless enabling high operating speeds without excessively strong pulses induced by the movement of the squeegee, the length—for example, in relation to the screen printing stencil 31; 32 in the circumferential direction on the inner circumferential surface—of the throwing-on phase $P_{on}$ and/or of the throwing-off phase $P_{off}$ is, for example, between 80 mm and 200 mm, in particular between 110 mm and 150 mm. However, the sum of the length of a throwing-off phase $P_{off}$ and the length of a throwing-on phase $P_{on}$ is equal, for example, at most to the length $L_N$ of the circumferential section $U_N$ that is not usable for printing, which in this case is determined, for example, at least by the width of opening 28, as viewed in the circumferential direction, and by the distance $a_S$ upstream of the trailing pit edge, and if applicable by the length of the aforementioned overlap of an optionally provided covering element 29.

Figure 5:
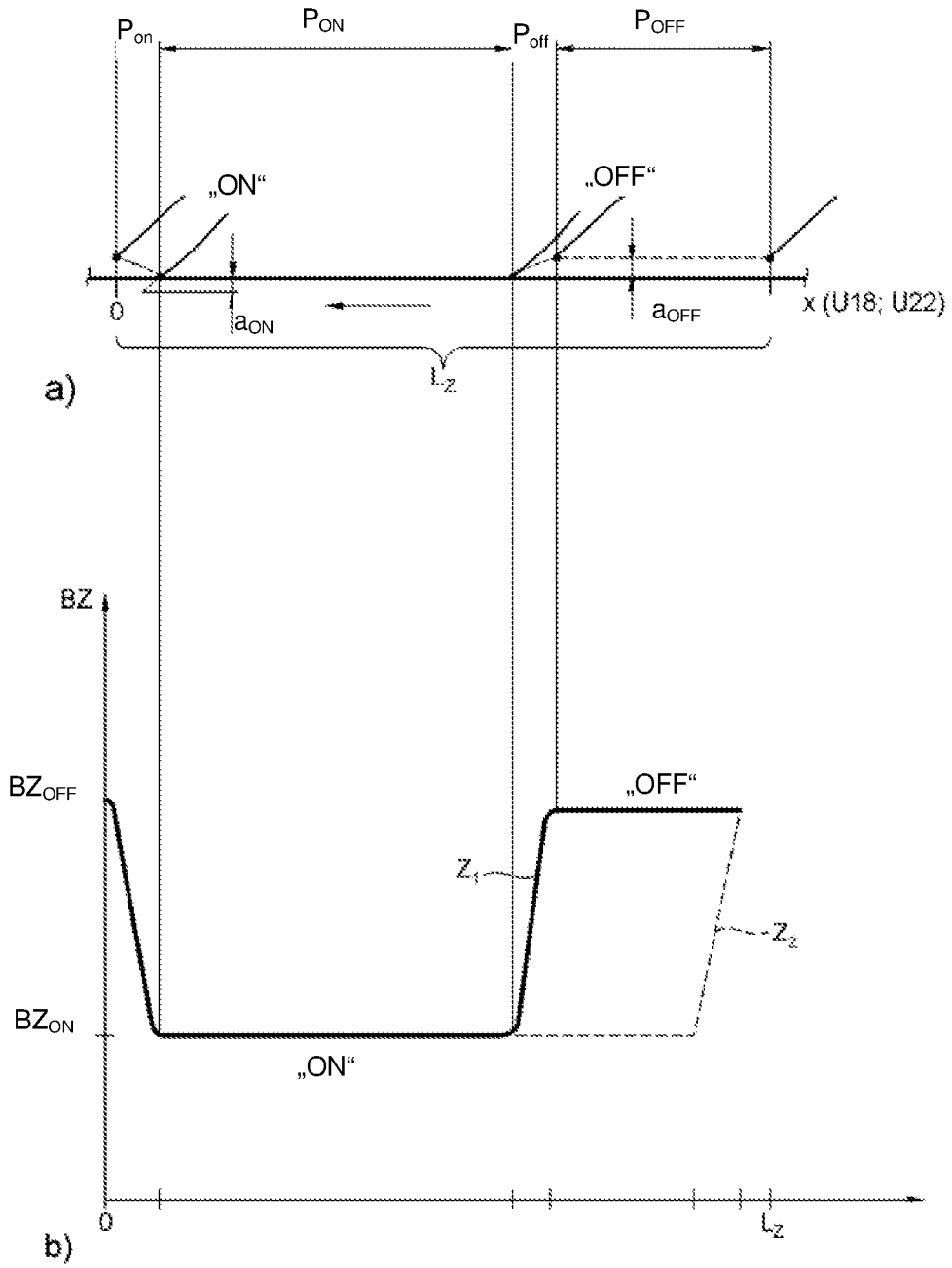
FIG. 5 a diagram illustrating the principle of a) the series of phases within a throwing-on and throwing-off sequence and b) the associated operating modes relating to the drive.

Squeegee device 33 comprises (see, for example, FIG. 9) a control device 39, by means of which squeegee 34 is or can be thrown on and off in the aforementioned correlation to the press phase of the printing press and/or to the advancement of printing substrate 02. In particular, control device 39 can be used to actuate a drive means 41 that brings about the throwing-on and throwing-off movement of squeegee 34 in the aforementioned correlation to the press phase of the printing press and/or to the advancement of printing substrate 02, in such a way that squeegee 34 is located alternatingly in the thrown-on position "ON" for an interval of time that corresponds to the length of phase $P_{ON}$ with squeegee 34 thrown on and—in particular following a transition phase that is dependent on the duration of the phase change—in the thrown-off position "OFF" for an interval of time that corresponds to the length of phase $P_{OFF}$ with squeegee 34 thrown off. For this purpose, drive means 41 is controlled by control device 39 in such a way that, during the phase $P_{ON}$ with squeegee 34 thrown on, or for the corresponding interval of time $T_{ON}$, the drive device is in an operating state $BZ_{ON}$ that brings about the thrown-on position "ON", and during the phase $P_{OFF}$ with squeegee 34 thrown off, or for the corresponding interval of time, the drive device is in an operating state $BZ_{OFF}$ that brings about the thrown-off position "OFF" (see, for example, as schematically illustrated in FIG. 5).

Control device 39 can be formed in this case by an integrated or distributed control circuit 39 or by an integrated data processing means or distributed data processing means 39 that are in signal communication with one another, and comprises switching and/or data processing means for carrying out a correlation as described above. Control device 39 may be wholly or partially integrated into a press control system that is connected to other actuating means and/or drive means of the printing press, or may be wholly or partially provided expressly for controlling squeegee 34.

Said correlation of the sequence related to a cycle length $L_Z$ to the press phase and/or to the advancement of the printing substrate is accomplished, for example, by transmitting signals $S_K$ that represent the press phase and/or the advancement of the printing substrate via a signal connection 35 between control device 39 and a master axis encoder 42 that represents the press phase of the printing press and/or the advancement of printing substrate 02 and serves to control the squeegee, for example, as master 42. Said master axis encoder may be provided, for example, by a sensor system 42 that detects the relevant press phase of the printing press and/or the advancement of printing substrate 02, and/or by a drive controller 42 that controls the indirect or direct driving of cylinder 21. In an embodiment that is particularly suitable for press retrofitting, this may be a sensor system 42 that is already provided in the press and is assigned to a component to be driven true-to-register, for example the infeed drum. For presses in which multiple components or component groups relating to transport and/or printing are rotationally driven by mechanically independent drive motors via a common electronic master axis, the master axis encoder 42 that serves as master 42 for squeegee control is or can be formed by such an electronic master axis 42, which serves as master for a plurality of additional drive motors of the printing press. Such a master axis 42 in the form of an actual electronic master axis 42 can follow the rotational movement of an actual angle signal, or in the form of a virtual master axis can be generated by data processing means and specified for all follow-on drives that are coupled to it. In that case, signal connection 35 is formed by the coupling to electronic master axis 42 and is embodied, for example, as a bus system or network system.

Squeegee device 33—in particular said control device 39 that throws squeegee 34 on and off in correlation to the press phase of the printing press and/or to the advancement of printing substrate 02—comprises control means 43, with which a length and/or position of at least one phase $P_{ON}$ that relates to the thrown-on position "ON" can be and/or is varied within a recurring throwing-on and throwing-off cycle, on the basis of information I(F); I($L_B$); I(M) that relates to or represents the printing substrate format and/or the print image. More particularly, the information I(F); I($L_B$); I(M) that relates to or represents the printing substrate format, in particular its length, and/or the print image is information I(F); I($L_B$); I(M) about the printing substrate length L02 as viewed in the direction of transport or about the print image length $L_B$ in relation to the printing substrate sheets 02 or about the print pattern to be printed by printing unit 06; 07. As a result, the length and position of the phase $P_{ON}$ can stand both for the length as measured in the circumferential direction on the interior of the screen printing forme and for the temporal equivalent thereof as an interval of time or chronology, connected by the circumferential speed.

In a first variant, for the format-dependent or print image-dependent control of the phase length and/or phase position of two or more discrete values or value ranges for the relevant information I(F); I (L44); ($I_M$), a corresponding number of discrete phase lengths and/or phase positions for the phase $P_{ON}$ with squeegee 34 thrown on, and/or a corresponding number of phase positions—at least partially spaced from one another, for example—for the end of the phase $P_{ON}$ with squeegee 34 thrown on—may be stored or provided, for example, in or by means of control means 43.

In an alternative, however, it may be provided that, dependent on a value that is derived from a continuous range of values for the information I(F); I($L_B$); $I_{(M)}$ in question, the control means 43 provides or supplies a value for the phase length and/or phase position of the phase $P_{ON}$ with squeegee 34 thrown on or for the phase position of the end of the phase $P_{ON}$ with squeegee 34 thrown on from a value range that is continuous—and restricted in terms of maximum and minimum, for example. "Continuous" is also understood as a sequence of equidistant discrete steps, determined, for example, by limitation or rounding to the smallest increments in question and/or manipulated in the variable in question.

Control device 39 processes signals $S_K$ relating to the aforementioned correlation into signals $S_R$ for controlling the throwing-on and throwing-off movement of squeegee 34, factoring in a specific phase length and/or phase position for the phase $P_{ON}$ or phases $P_{ON}$ relating to the thrown-on position "ON" within a cycle or cycle length $L_Z$. The specific phase length and/or phase position is acquired and supplied by control means 43 dependent on the printing substrate format, in particular its length, and/or on information I(F); I($L_B$); I(M) that characterizes and/or relates to the print image, in this case, for example, also combined under the umbrella designation of information I relating to the print run (see, for example, FIG. 9).

The control means 43 that are contained in control device 39 for the correlated, in particular synchronized drive, for example, for supplying the format- and/or print-image-dependent phase length and/or phase position can in turn be formed by one or more integrated or distributed circuit and/or data processing means, the latter comprising circuit and/or data processing means for determining a phase length relating to the thrown-on position "ON" and/or the phase position dependent on the aforementioned received information I(F); I($L_B$); I(M) relating to format and/or print image.

The control means 43 that are contained in control device 39 may be wholly or partially integrated—in accordance with control device 39 itself—into a press control system that is connected in terms of control engineering to other actuating and/or drive means of the printing press, for example, a planning and/or control level 47, or may be provided peripherally and in close proximity to the drive means 41 to be controlled.

The length and/or position of the at least one phase $P_{ON}$ with squeegee 34 thrown on, or the corresponding or temporal arrangement, or a movement profile that factors in this length or this time interval, is determined and/or provided based on an assignment specification contained in control means 43, dependent on the information I(F); I($L_B$); I(M) to be considered. The assignment specification may be provided in tabular form or as a functional correlation in a computing and/or storage means 55 contained in control means 43. This is also understood as a complex specification by which, based on the information I(F); I($L_B$); I(M) to be considered, a movement profile that factors in the specific length and/or position is determined and/or created.

The information I(F); I($L_B$); I(M) that determines the phase length and/or the phase end or phase position may be made available to control means 43 by the planning and/or control level 47 via a signal connection 45, for example. This can be implemented, for example—particularly in the case of information I(F); I($L_B$) that relates to or represents the printing substrate format F and/or the print image—from a control console assigned to the planning and/or control level 47. On said control console, the corresponding information I(F); I($L_B$) itself or details relating to this information I(F); I($L_B$) to be processed may be manually selected or input via an operator interface, for example. In a more automated form, the information I(F); I($L_B$) or the details relating to said information I(F); I($L_B$) to be processed are or can be obtained from data relating to product and/or production planning that are already available electronically in the planning and/or control level 47 or in a prepress stage. In one variant—which is preferable when information I($L_B$); I(M) relating to the printing length or the print pattern will be used—the relevant information I($L_B$); I(M) is or can be obtained from data that are already available in the prepress stage for the print image segment in question.

Here, the term "phase length" or "phase position," unless otherwise expressly stated, as a short form for the aforementioned "length" or "position," is or can be understood to include both the size and the position, respectively, of the phase in question in terms of space (position, angle) and—over the speed profile—the time equivalent thereof as the interval of time or the relative position within the synchronized cycle length $L_Z$. The instants for the phase change in each case, and thus the phase length and the phase position, are determined, for example, in relation to the press phase position and/or in relation to the printing substrate phase position.

Figure 6:
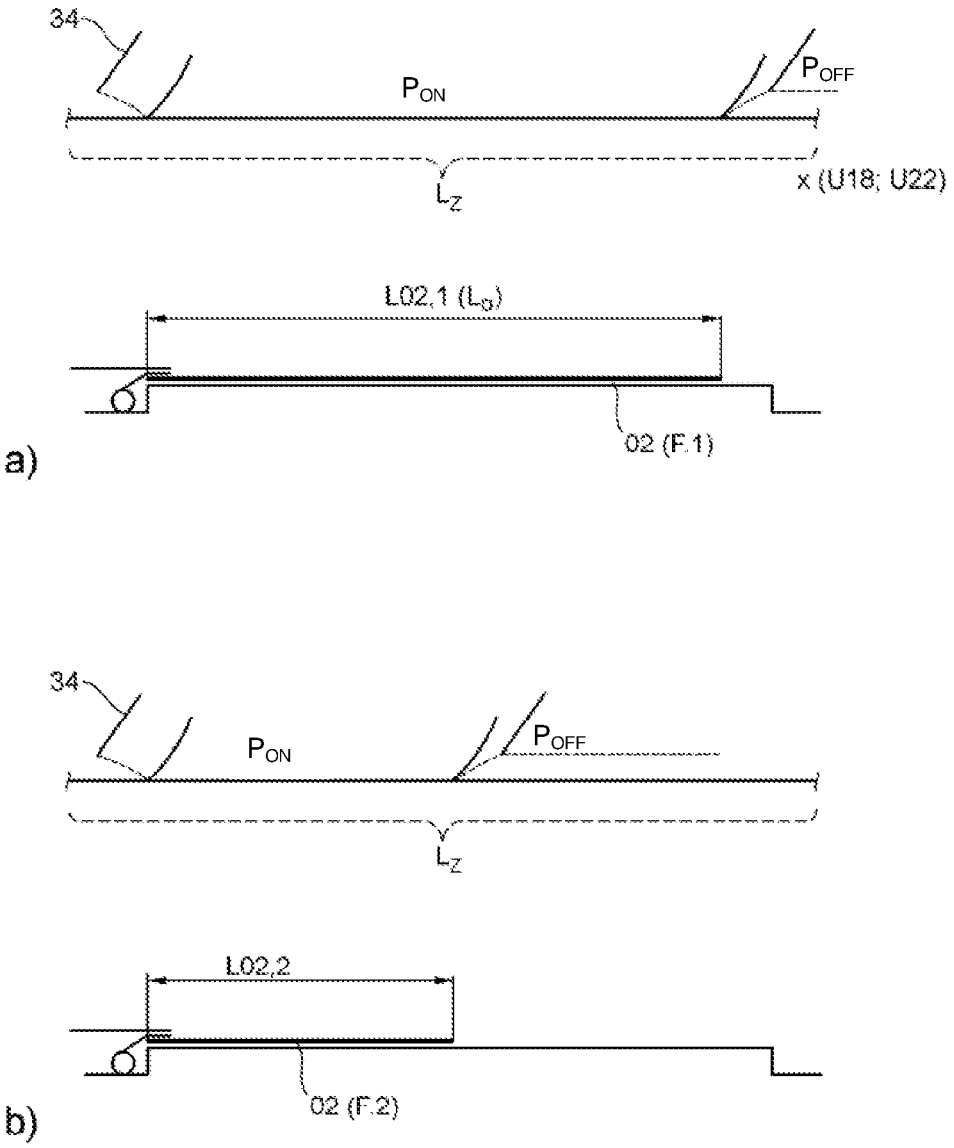
FIG. 6 a diagram illustrating the principle of the series of phases within a throwing-on and throwing-off sequence for a) a larger printing substrate format and b) a smaller printing substrate format.

In a first embodiment of the configuration of control means 43 or of the control of the squeegee movement, illustrated schematically, for example, in FIG. 6 in a side view of an unrolled cylinder shell comprising a usable circumferential section $U_D$, in a first operating situation, for example, printing substrate sections 02 of a first format F.1, that is, having a first printing substrate length L02,1, and in a second operating situation, printing substrate sections 02 of a second format F.2, that is, having a second printing substrate length L02,1, can be or are printed. Dependent on the printing substrate length L02,1; L02.2 in question or on information I(F) that represents said length, the phase length of the phase $P_{ON}$ with squeegee 34 thrown on, or—as is preferred in this case—the end of the phase $P_{ON}$ with squeegee 34 thrown on is determined by control device 39, and/or, dependent on the printing substrate length L02,1; L02.2 in question or on information I(F) that represents said length, squeegee 34 is thrown on and thrown off in respective cycles Z1; Z2 (see, for example, FIG. 5), in which phase lengths that differ from one another for the respective phase $P_{ON}$ with squeegee 34 thrown on or—as is preferred in this case—phase positions that differ from one another for the end of the respective phase $P_{ON}$ with squeegee 34 thrown on are or can be assigned to the different printing substrate lengths L02,1; L02.2. In this case, the phase position for the beginning of the phase $P_{ON}$ in question with squeegee 34 thrown on can be specified in each case as the same and, for example, a fixed but optionally variable phase position. Said phase position can lie upstream of the beginning of the circumferential section $U_N$ that is usable for printing, as described above, for example.

Figure 7:
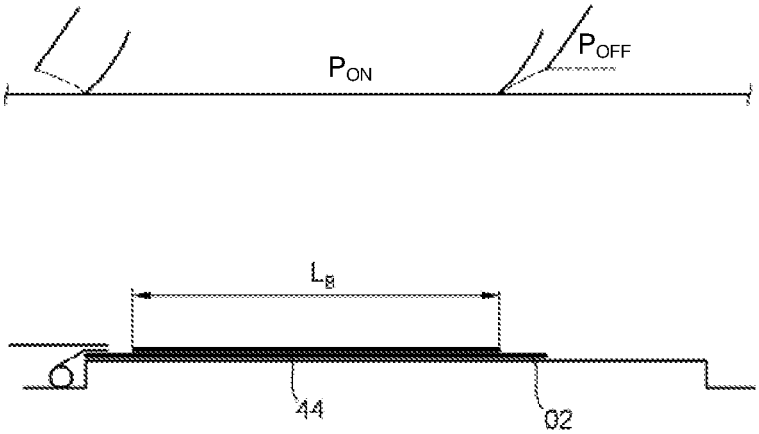
FIG. 7 a diagram illustrating the principle of the series of phases within a throwing-on and throwing-off sequence, dependent on the position and length of the current print image length ($L_B$)

In a second embodiment that may be implemented or provided in place of or as an alternative to the first embodiment, as illustrated schematically, for example, in FIG. 7 in a side view of an unrolled cylinder shell comprising a usable circumferential section $U_D$, the phase length of the phase $P_{ON}$ with squeegee 34 thrown on, or at least one end of the phase $P_{ON}$ with squeegee 34 thrown on, is determined by control device 39 dependent on the respective print image length $L_B$ or on information $I(L_B)$ that represents said length. Print image length $L_B$ is understood in this case, for example, as the length that is limited on the leading side by the first, and on the trailing side by the last ink application to be produced by printing point 06; 07. The printing area 44 lying therebetween can have continuous or discontinuous printing areas 44. For operating situations that involve different print image lengths $L_B$, dependent on the respective print image length $L_B$ or on information $I(L_B)$ that represents said length, squeegee 34 is thrown on and off in respective cycles Z1; Z2, in which phase lengths that differ from one another for the respective phase $P_{ON}$ with squeegee 34 thrown on, or phase positions that differ from one another for the end of the respective phase $P_{ON}$ with squeegee 34 thrown on are or can be assigned to the different print image lengths $L_B$. In this case, the phase position for the beginning of the respective phase $P_{ON}$ with squeegee 34 thrown on may be the same, and, for example, a fixed phase position, but is optionally a variable phase position. Said position may even lie upstream of the beginning of the circumferential section $U_N$ that is usable for printing, as described above. In this case, as above, the phase position for the beginning of the respective phase $P_{ON}$ with squeegee 34 thrown on may be the same in each case, or may be a phase position that is dependent on the beginning of the print image.

Figure 8:
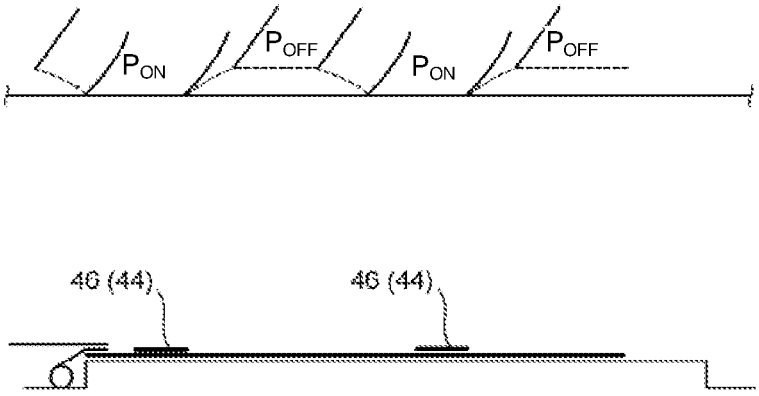
FIG. 8 a diagram illustrating the principle of the series of phases within a throwing-on and throwing-off sequence, dependent on the position, length and number of printing strips in a current print image length ($L_B$)

In a third embodiment that can be implemented or provided, optionally in place of or as an alternative to the first and/or second embodiment, as illustrated schematically, for example, in FIG. 8 in a side view of an unrolled cylinder shell comprising a usable circumferential section $U_D$, for each cycle length $L_Z$ a plurality of phases $P_{ON}$ with squeegee 34 thrown on and a plurality of phases $P_{OFF}$ with squeegee 34 thrown off may be provided. In this case, a beginning and an end of each of phases $P_{ON}$ with squeegee 34 thrown on are determined by control device 39 dependent on information I(M) that represents the phase position, as viewed in the transport direction, of printing strips 46 of a printing area 44 that is interrupted by printing strips that will not be printed. For operating situations that have different patterns of strips to be printed and strips that will not be printed, an individual, and depending on the distribution of the printing strips 46 in each case or on information I(M) that represents said distribution, multiple throwing-on and throwing-off movements of squeegee 34 are carried out in each cycle, in which mutually different patterns for the phase positions and/or phase lengths, that is, the position of the beginning and the end of each phase $P_{ON}$ with squeegee 34 thrown on, are or can be assigned to the printing areas 44 that differ from one another in terms of the distribution of printing strips 46. The information I(M) relating to the number and/or position of the printing strips 46 is based, for example, on data that can be or are obtained by analyzing the print image to be printed by printing point 06; 07, in particular by analyzing the target print image, which is present in the form of data, for example, in the prepress stage. In this case, strips that are to be printed, which are separated, for example, by narrower strips that are not to be printed, are or can be combined to form larger printing strips 46, despite their discontinuity.

Particularly in connection with the first and second embodiments, the ratio of the phase length, in relation to the length of the inner circumference that is traversed along the screen printing stencil, of the phase $P_{ON}$ relating to the thrown-on position "ON" and the phase $P_{OFF}$ relating to the thrown-off position "OFF" can be varied by means of control means 43 within the preferably fixed cycle length $L_Z$.

The bearing and drive device for squeegee 34, which enables the throwing-on and throwing-off movement in the aforementioned embodiments, may have any embodiment, provided it comprises preferably at least one squeegee 34 that can be correspondingly thrown on and off, and a drive 41, 48 that is and/or can be operated mechanically independently of the rotary drive of screen printing cylinder 18; 22 and/or of impression cylinder and/or transport cylinder 21. Said drive can be transferred, for example, —in particular without mechanical coupling to the drive of screen printing cylinder 18; 22 or of impression cylinder and/or transport cylinder 21—either to an operating state $BZ_{ON}$ that brings about the thrown-on position "ON" of squeegee 34 or to an operating state $BZ_{OFF}$ that brings about the thrown-off position "OFF" of squeegee 34 (see, for example, FIGS. 5*b*) and 5*a*).

Drive 41, 48, which is and/or can be operated mechanically independently of the rotary drive of screen printing cylinder 18; 22 and/or of impression cylinder and/or transport cylinder 21 and/or is configured without mechanical drive coupling to the rotary drive of screen printing cylinder 18; 22 and/or impression cylinder and/or transport cylinder 21, can have any desired configuration in principle, provided it will enable squeegee 34 to be thrown on and off in the manner described. The nature of the movement of squeegee 34 and/or the configuration of the drive may have any desired embodiment, in principle. The following examples reflect particularly advantageous embodiments, but are not intended as a restriction of the underlying functional solution.

A drive 41, 48 of this type comprises at least one controllable drive means 41. Said drive means may be configured, for example, as a drive means 41 that is actuable by means of pressurized fluid (see, for example, FIG. 10), such as, for example, a cylinder/piston system that can be acted on by pressurized fluid, for example, a hydraulic or pneumatic cylinder drive, or—as is preferred here—as a motor 41—preferably angular position controllable—(see, for example, FIG. 11 or FIG. 12), such as, for example, an electric motor 41, for example as a linear motor or preferably as a rotary electric motor 41.

On the output side, drive means 41 is operatively connected directly or indirectly via a corresponding coupling to the squeegee 34 to be moved. The operative connection can act on squeegee 34 directly, without any gear mechanism, or via a gear mechanism 48.

Figure 10:
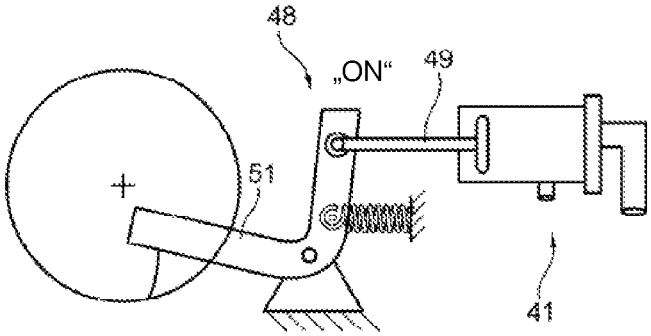
FIG. 10 a first example of the embodiment of the drive device.

In a first embodiment, a gear mechanism of this type can be formed, for example, by a gear mechanism 48 that converts a linear movement of a linearly acting drive means 41, for example, a drive means 41 that can be actuated by a pressurized fluid, to a throwing-on/throwing-off movement of squeegee 34, for example, comprising a tappet 49 and/or a one-armed or two-armed lever 51 (see, for example, FIG. 10).

Figure 11:
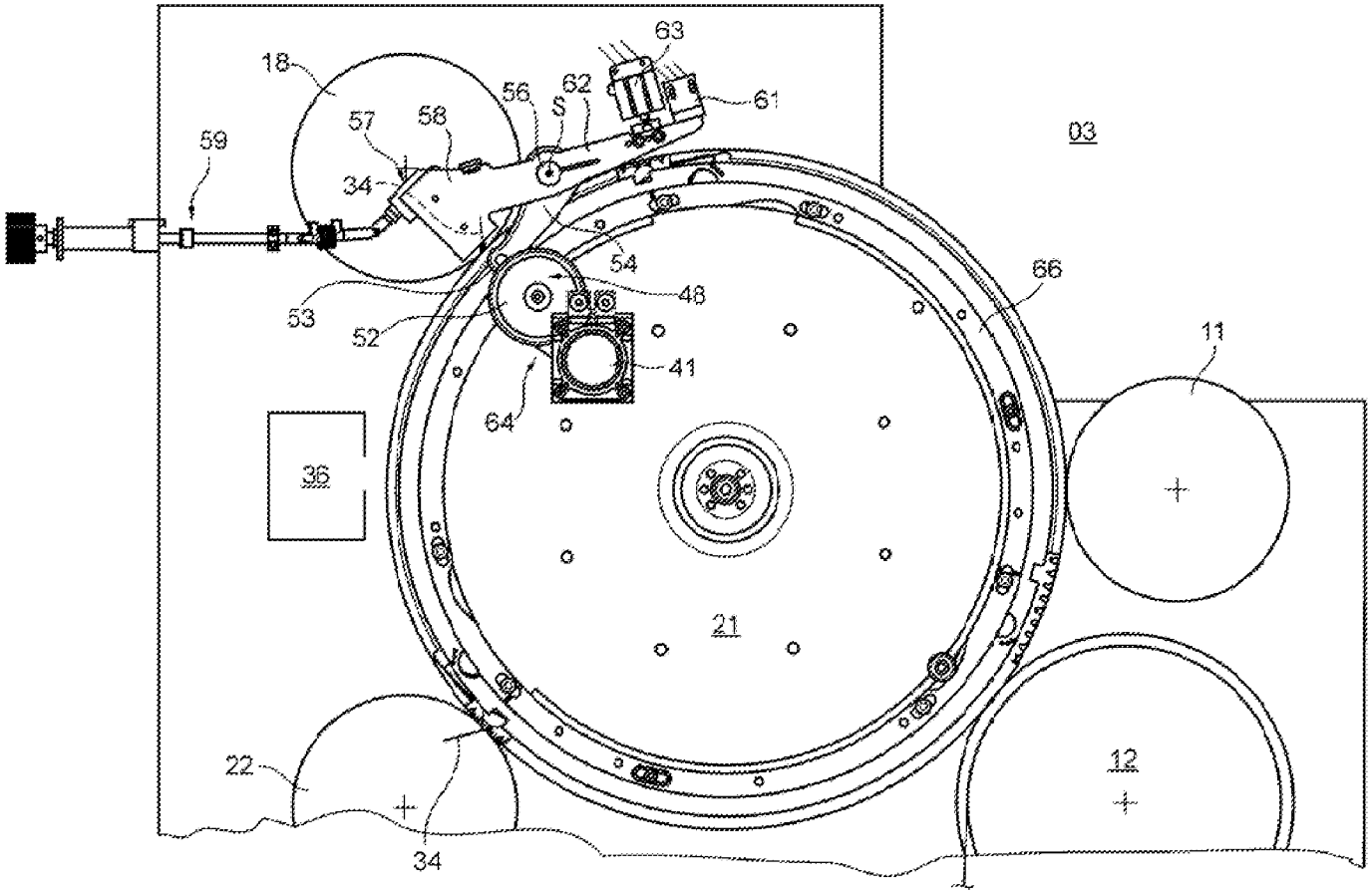
FIG. 11 an end face view of a second example of the embodiment of the drive device.
Figure 12:
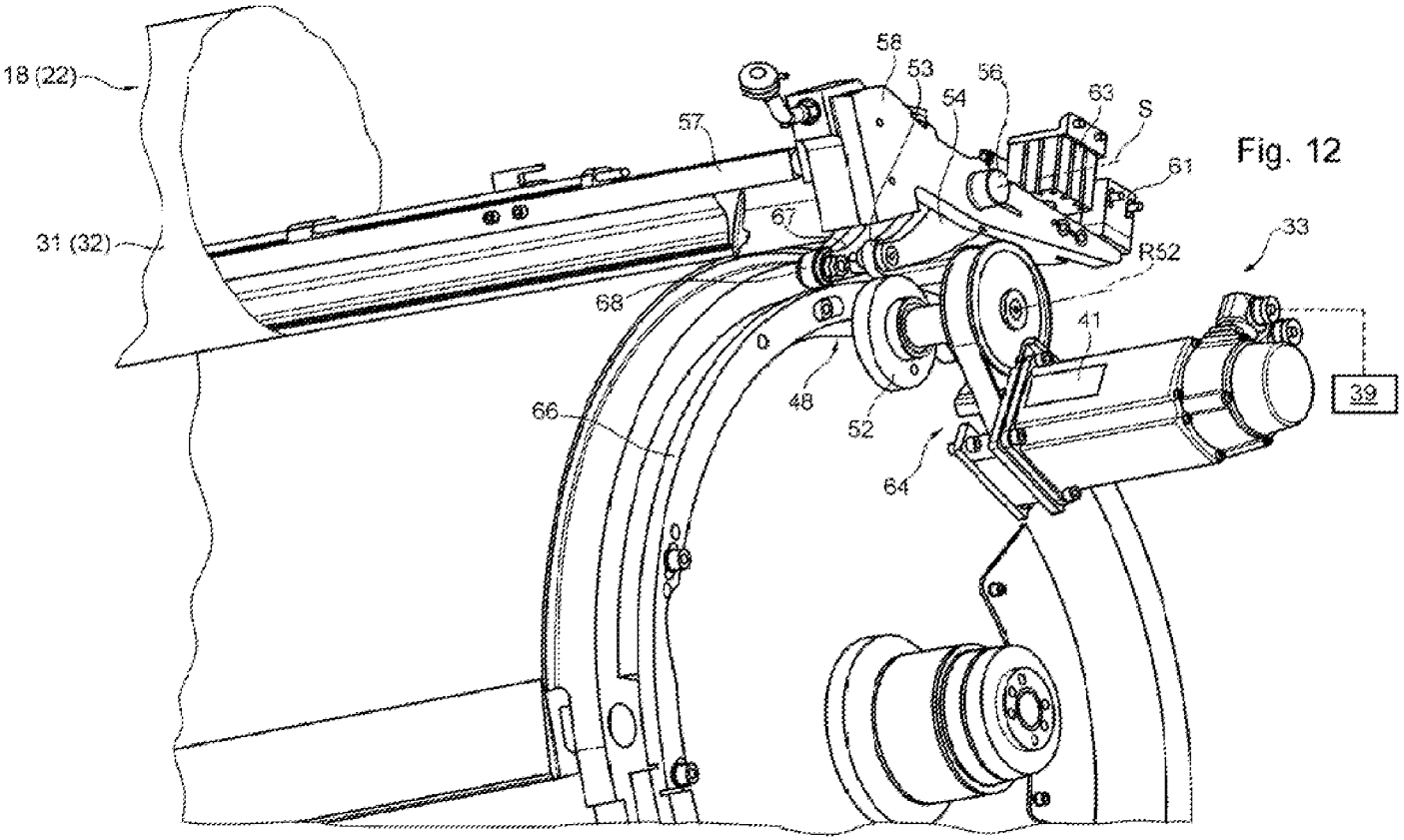
FIG. 12 a perspective, oblique view of the embodiment according to FIG. 11.
Figure 13:
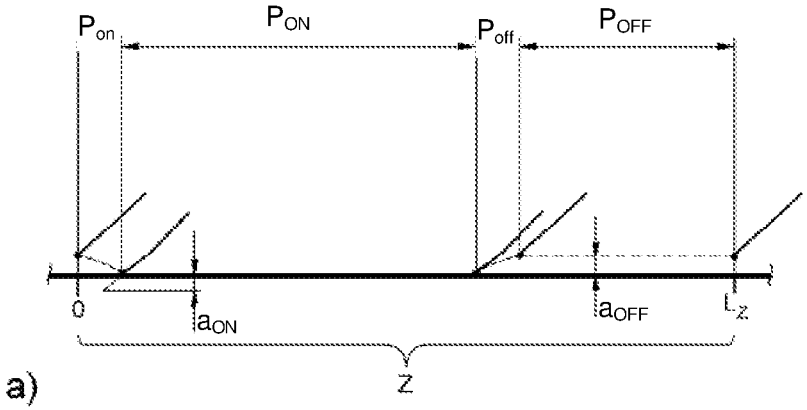
FIG. 13 a diagram illustrating the principle of a) the series of phases within a throwing-on and throwing-off sequence and b) an example of an associated movement profile between a master phase position and the slave axis relating to the cam disk.
Figure 13:
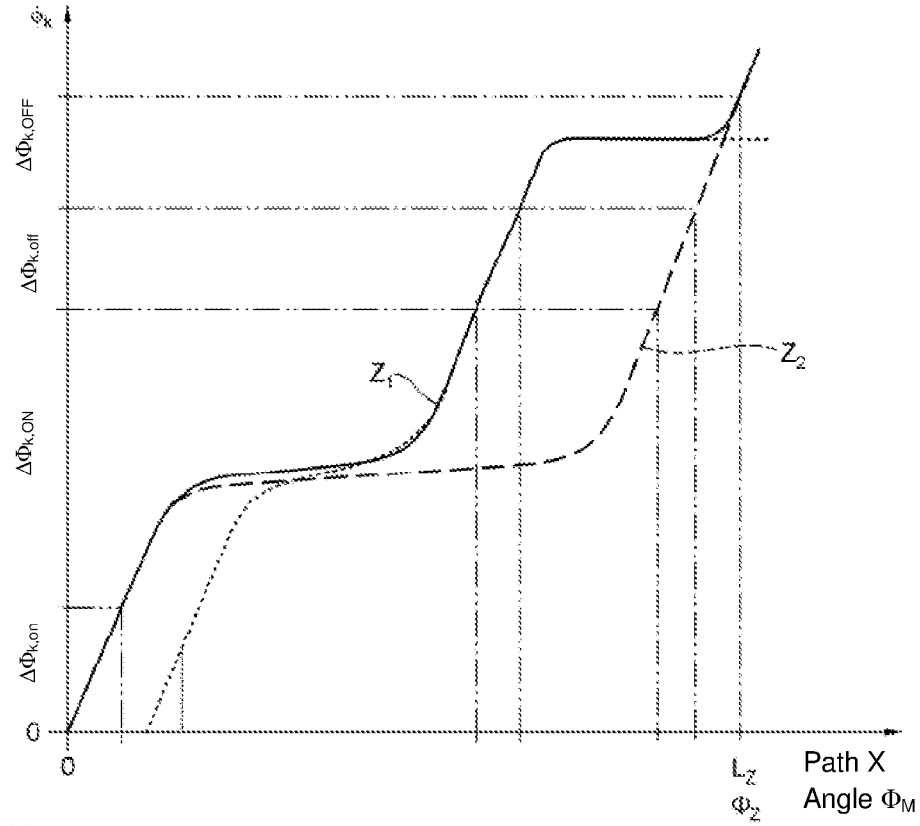
Figure 14:
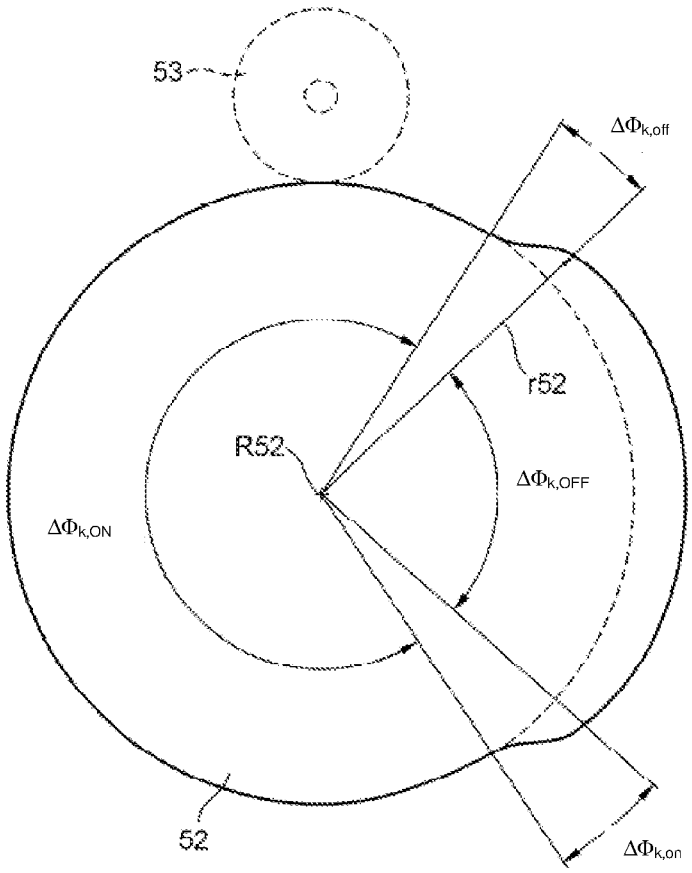
FIG. 14 a diagram illustrating the principle of a single-revolution cam disk, with the degree of offset in relation to the circumferential line shown superposed.

In an advantageous embodiment of the drive, set forth herein, the coupling can be achieved or implemented via a gear mechanism 48 that converts a rotational movement of a rotary drive means 41, for example an electric motor 41, to an throwing-on/throwing-off movement of squeegee 34 (see, for example, FIG. 11 to FIG. 13).

In the particularly advantageous embodiment, set forth, for example, in FIG. 11 to FIG. 14, gear mechanism 48 is formed by a cam mechanism 48. A stop element 53, for example, a roller 53, which is held in a coupling link 54, cooperates with the circumferential line that deviates from the arc-shaped profile (shown superposed, for example, in FIG. 14 for the purpose of clarity) of a cam disk 52 that is rotatable about a fixed rotary axis R52. Said stop element follows the profile of the cam and, upon rotation of cam disk 52, transmits the radial stroke induced by the shape of the cam to coupling link 54. Coupling link 54 can be configured, in principle, so as to transmit said movement to squeegee 34 in the manner of a tappet, but is preferably embodied as a lever arm 54 that is connected non-rotatably to a shaft 56. Shaft 56 is mounted on the frame so as to pivot about a pivot axis S that is fixed to the frame. An additional lever arm 58, which supports squeegee 34 via a squeegee support 57, is likewise connected non-rotatably to shaft 56. Lever arms 54; 58 may be the arms of the same two-armed lever 54, 58 or may be embodied as lever arms 54; 58 of different levers, connected to shaft 56.

To limit the thrown-on position "ON" mechanically, a stop 61 that is fixed to the frame and limits the pivoting movement of shaft 56 in the throwing-on direction may be provided. For this purpose, said stop can cooperate with one of said lever arms 54; 58 or with an additional lever arm 62 that is non-rotatably connected to shaft 56. If applicable, stop 61 may be adjustable for setting the thrown-on position "ON". Here, lever arm 62 that cooperates with stop 61 is part, for example, of a two-armed lever 58, 62 formed by said lever arm and the lever arm 58 that supports squeegee support 57.

In place of or in addition to the adjustability of stop 61, squeegee support 57 may be mounted for adjustment on or in lever arm 58, via a device not specified in greater detail here, such that said lever arm can be moved in relative terms with at least one movement component in the radial direction of screen cylinder 18; 22 and can be actuated by means of a corresponding actuating device 59 in terms of its spacing from the inner side of screen printing forme 31; 32.

To enable a throwing-off process that is independent of the operationally controlled actuating drive 41, 48 of squeegee 34, for cases of emergency and/or for maintenance or servicing purposes, an additional drive means 63 that is different from the former drive means 41 can be provided. Said additional drive means can be embodied, for example, as a drive means 63 that is actuable by means of pressurized fluid, for example a hydraulic or pneumatic cylinder, and/or that cooperates for its pivoting, for example, with one of the provided lever arms 54; 58; 62.

Cam disk 52 can be driven axially, for example, or as illustrated, via a gear mechanism 64, in particular a belt drive.

Independently, in principle, of the specific embodiment of controlled drive 41, 48 for the throwing-on and throwing-off movement, but preferably in conjunction with the stated embodiment comprising the cam mechanism, in addition to controlled drive 41, 48, a purely mechanical drive 66, 67, 68 is provided, by means of which squeegee 34 can be lifted off of the inner lateral surface of screen printing stencil 31; 32 for at least a phase length that corresponds to the width of break 28 on the lateral surface of the impression cylinder and/or transport cylinder 21, in particular at least the length of the circumferential sections $U_N$ that are not usable for printing. The mechanism can be embodied such that, during trouble-free operation, squeegee movement is determined solely by the controlled drive 41, 48, and the mechanical drive intervenes only in the event of a failure of the controller.

For example, the mechanical drive 66, 67, 68 comprises a cam mechanism having a cam disk 66, which is connected in a rotationally fixed manner to the impression cylinder and/or transport cylinder 21, with a stop element 68, for example a roller 68, cooperating with the circumferential line of said cam disk. Said stop element follows the profile of the cam and, upon rotation of the cam disk 66, transmits the radial stroke induced by the shape of the cam to coupling link 67. Coupling link 67 may also be embodied, in principle, so as to transmit the movement in the manner of a tappet to squeegee 34 or to squeegee holder 57, but is preferably embodied as a lever arm 67 that is connected co-rotatably to a shaft. If controlled drive 41, 48 is embodied as having a pivotable shaft 56 that is connected to the lever arm 58 that supports squeegee holder 57, lever arm 67 can likewise engage on said shaft 56.

The cam of the purely mechanical drive can be adjusted together with the mechanism that transmits the stroke movement in such a way that the cam segment that brings about a lifting-off or throwing-off of squeegee 34 exerts no influence when the controlled drive 41; 48 is operating in a trouble-free manner. Thus, for example, in this cam segment stop element 68 is in physical contact with the cam, or is spaced from the cam, preferably by a distance slightly greater than zero, for example by no more than 1 mm, in particular by no more than 0.1 mm, at least in the circumferential region that relates to the circumferential sections $U_N$ that are not usable for printing.

In the presented embodiment of drive 41, 48 which is controlled via a cam mechanism 48 (see, for example, FIG. 14), cam disk 52 can, in principle, have a radius r52 of any size, that is, with any size spacing between the highest point on the cam line and the rotary axis. The cam, the circumferential surface of which is impressed, may be embodied as single-revolution, that is, having only one sequence of a series of one or more angular segments $\Delta\Phi_{k,OFF}$ that have a higher circumferential section, that is, a section that extends along a larger radius, and one or more angular segments $\Delta\Phi_{k,ON}$ having a lower circumferential section, that is, a circumferential section that extends along a smaller radius, the higher and lower circumferential sections being interconnected by angular segments $\Delta\Phi_{k,off}$; $\Delta\Phi_{k,on}$ that represent transition areas $\Delta\Phi_{k,off}$; $\Delta\Phi_{k,on}$ across a continuously extending cam line, for example (see as superposed by way of example in FIG. 14). In another embodiment, in which the rotational speed is reduced, for example, and/or transition areas $\Delta\Phi_{k,off}$; $\Delta\Phi_{k,on}$ can be embodied having a smaller curvature, the cam disk may also be configured as a multi-revolution disk, that is with multiple sequences, each having the same pattern in the series of higher and lower angular segments $\Delta\Phi_{k,OFF}$, $\Delta\Phi_{k,ON}$, in succession in the circumferential direction. With a multi-revolution embodiment, cam disk 52 is or can be operated at a rotational speed that is lower according to the factor. Depending on the specific configuration of the coupling, the angular segment $\Delta\Phi_{k,OFF}$ having a higher circumferential section can correspond to the operating state $BZ_{OFF}$ that brings about the thrown-off position "OFF", and the angular segment $\Delta\Phi_{k,ON}$ having a lower circumferential section can correspond to the operating state $BZ_{ON}$ that brings about the thrown-on position "ON", or vice-versa.

Particularly advantageously for the aforementioned case of a control that is based on the present print format F,1; F,2 and/or on an entire print image length $L_B$, but not limited thereto, the cycle length $L_Z$ for a cycle with respect to squeegee control on cam disk 52 is assigned only one sequence—hereinafter also referred to as a single-phase sequence, for example—which comprises only one angular segment $\Delta\Phi_{k,OFF}$; $\Delta\Phi_{k,ON}$ having a circumferential section that brings about the thrown-off position "OFF" and one angular segment $\Delta\Phi_{k,OFF}$; $\Delta\Phi_{k,ON}$ having a circumferential section that brings about the thrown-on position "ON", each also having an angular segment $\Delta\Phi_{k,off}$; $\Delta\Phi_{k,on}$ that forms a transition. In a multi-revolution embodiment, a plurality of these single-phase sequences may be provided on the circumference of cam disk 52.

In particular in the case of a control related to a printing strip, but not limited thereto, in an alternative, multi-phase embodiment of the sequence, for each cycle length $L_Z$ to be traversed, a plurality of angular segments $\Delta\Phi_{k,OFF}$; $\Delta\Phi_{k,ON}$ having circumferential sections that bring about the thrown-off position "OFF" and a plurality of angular segments $\Delta\Phi_{k,ON}$; $\Delta\Phi_{k,OFF}$ having circumferential sections that bring about the thrown-on position "ON" can be provided.

With a constant cycle length $L_Z$—for example factoring in transition phases "$P_{on}$"; "$P_{off}$"—in order to vary the distribution between the phase lengths that relate to the thrown-on position "ON" and those that relate to the thrown-off position "OFF", and/or the positions thereof in the aforementioned dependency on the format and/or on the print image, cam disk 52 is or can be driven—in principle independently of a single-revolution or multi-revolution and/or a single-phase or multi-phase embodiment of its cam—via drive motor 41 and, if applicable, via a drive controller 69 situated upstream of drive motor 41 (see, for example, FIG. 9) by means of control device 39, with an angular speed that varies over the course of a full revolution of cam disk 52.

Drive 41; 48 of cam disk 52 preferably is or can be acted on for its rotational movement during operation by a movement profile—specific, for example, to the present format F and/or print image—in which the respective sequence is synchronized with respect to its phase position and phase length to the press phase of the printing press and/or to the advancement of printing substrate 02, in particular to the signals $S_K$ from the master connected to the squeegee controller that represent the position and/or movement of the press axis and/or the printing substrate. In this process, sequence and cycle can be shifted overall relative to one another—in terms of the absolute angle—by a fixed value which is dependent on the position of the cam disk relative to the press axis. Drive 41; 48 of cam disk 52 is therefore implemented or is acted on by a movement profile such that the full sequences and cycles are traversed in synchronization with one another and with the movement of the press axis and/or the printing substrate—with the exception of a possible fixed offset.

Within each sequence, the rotational movement of cam disk 52 follows the movement of the press axis and/or the printing substrate or the signal $S_K$ that represents said movement, but not necessarily along a linear relationship; instead, it follows a movement profile having an at least partially non-linear relationship between the position of the press axis and/or the printing substrate or the master signal $S_K$ that represents said position and the required and/or assumed angular position $\Phi_K$ for cam disk 52, or cam angular position $\Phi_K$.

The specific movement profile that deviates from a purely linear relationship and that exists within the cycle length $L_Z$ for the rotational movement of the cam disk is based on the result of the assignment specification stored in control means 43 for the information I(F); I($L_B$); I(M) that represents the printing substrate format and/or print image in question. This applies generally to any embodiment of the drive 41, 48. In the case considered here of a cam mechanism 48, the resulting movement profile within a cycle length $L_Z$ and/or sequence length comprises phases of lower and/or higher angular speed, in which the length, in relation to the duration, of the operating state $BZ_{ON}$ relating to the thrown-on position "ON" and/or of the operating state $BZ_{OFF}$ relating to the thrown-off position "OFF" is defined within the cycle length $L_Z$ over the size and/or duration of the lower or higher angular speed of cam disk 52.

The specific movement profile assigned to control means 43 by the assignment specification for the relevant information I(F); I($L_B$); I(M) is or can be defined by a tabular or parameterized functional relationship—for example between the position of the press axis and/or the printing substrate or the master signal $S_K$ that represents said position and the required and/or assumed angular position $\Phi_K$ of cam disk 52. The movement profile acquired in the stated manner based on the assignment specification is or can be stored, for example, in control means 43, in particular in control means 43 located in close proximity to the drive. The value pairs in the relationship can be used directly for motor control, merely as incremental data points, for example, or, for example, merely as more widely spaced data points for a routine, for example, provided in drive controller 69, for example, such as an operating mode of an "electronic cam disk", by means of which, based on the data points, the incrementally required movement profile between the "input axis", in this case the press axis represented by the master signal $S_K$, for example, and/or the printing substrate advancement, and the "output axis", in this case, for example, the output axis on the cam disk side can be provided. In the process, a deviation from a single-revolution embodiment, which may exist on one or both sides, is accounted for by appropriate factors.

In general, the preceding teaching may also be applied in principle to a printing unit that operates according to flat screen printing or to a method that operates according to the flat screen printing method, provided this is not precluded by any obvious contradiction. For said purposes, printing substrate 02 may also be understood to include other types of substrates, for example, in addition to large flat articles, also molded articles and/or hollow bodies. In this case as well, the squeegee can be thrown on and thrown off with varying phase lengths and/or phase positions, dependent on information I(F); I($L_B$); I(M) that relates to the printing substrate format and/or the print image, in order to avoid, for example, an undesirable passage of ink into printing forme sections that are not intended for printing.

While preferred embodiments of a security printing device having at least one printing assembly, and a method for operating a squeegee device, in accordance with the present invention, have been set forth fully and completely hereinabove, it will be apparent to one of skill in the art that various changes could be made without departing from the true spirit and scope of the present invention, which is accordingly to be limited only by the appended claims.

The invention claimed is:

1. A security printing press having at least one printing assembly including a printing unit, by the use of which printing unit a sheet-type printing substrate can be printed on using a screen printing method, the printing unit having at least at one printing point formed between a screen cylinder and an impression cylinder, the at least one printing assembly having one or more drying units disposed downstream of the printing assembly on a printing substrate path, and having a squeegee device, which is part of the printing unit, which squeegee device comprises a screen printing forme, a squeegee, which is one of set against the screen printing forme in a thrown-on position ("ON") and can be set against the screen printing forme in the thrown-on position ("ON"), a bearing device, which enables a throwing-on and throwing-off movement of the squeegee between the thrown-on position ("ON") of the squeegee and a thrown-off position ("OFF") of the squeegee, and a squeegee drive device, by the use of which squeegee drive device, the squeegee can be thrown on and off of the screen printing forme during operation of the printing unit, in a manner which is correlated to one of a press and a printing substrate phase position, wherein an inking aid (29) is provided, by the use of which inking aid, an opening of a pit, located on a lateral surface of the impression cylinder and a retaining device for printing substrate sheets, and located in the pit, can be at least partially covered, at least temporarily, at least in a trailing area of the opening, and wherein the squeegee drive device includes a drive means, which can be controlled by a control device and by which the throwing-on and throwing-off movement of the squeegee one of can be and is brought about mechanically independently of the one of the press and the printing substrate phase position, and which squeegee drive device is configured to one of bring about and to enable a throwing on and throwing off of the squeegee in sequences that are different from one another, with one of phase positions and phase lengths that are different in relation to the length of the screen printing forme, the squeegee drive device comprising a cam mechanism which is driven by the drive means and by which the squeegee is thrown on and off, and wherein the control device controls the squeegee drive device to be driven at an angular speed which one of can be and is varied over the course of a full revolution of the cam disk.

2. The security printing press according to claim 1, further including an additional drying unit, which is provided between the at least one printing point and a point downstream in the printing substrate path, at which the printing substrate, on a side of the printing substrate, that has been printed by the at least one printing point, comes into physical contact with a succeeding rotary body.

3. The security printing press according to claim 1, wherein squeegee drive device can be placed in a first operating state (BZON) that brings about the thrown-on position of the squeegee ("ON") and in a second operating state (BZON) that brings about the thrown-off position of the squeegee, ("OFF") by use of the drive means, and without a mechanically rigid coupling to a press element that represents one of the press position and the printing substrate phase position.

4. The security printing press according to claim 1, wherein the control device, that is in signal communication with the drive means, throws the squeegee on and off, with one of varying phase lengths and phase positions, dependent on information I(F); I(LB); I(M) that relates to one of the printing substrate format and the print image, and that is provided to the control device.

5. The security printing press according to claim 1, wherein one of the length and position and number of phases (PON) relating to the thrown-on position "ON", within a recurring sequence that is fixed in terms of its length, can be varied by a control means contained in the control device, dependent on information I(F); I(LB); I(M) that relates to the one of printing substrate format and the print image.

6. The security printing press according to claim 1, wherein one of the drive means and the control device that controls the drive means is in signal communication with a master axis encoder configured as an electronic master axis, that represents the one of the press phase position and the printing substrate phase position, and which serves as a master for controlling the drive means in terms of one of the length and the position of a throwing-on and throwing-off sequence of the squeegee.

7. The security printing press according to claim 1, wherein the drive means of the squeegee drive device is a linearly acting drive means having a cylinder/piston system that can be acted on by one of pressurized fluid and an electrically operated linear drive.

8. The security printing press according to claim 1, wherein the drive means is embodied as one of an angular position controllable electric.

9. The security printing press according to claim 1, wherein the squeegee drive device, that brings about the throwing on and throwing off of the squeegee engages, on an output side, with a squeegee support that supports the squeegee, that extends within the screen printing forme, and that preferably extends over at least the length of the squeegee, as viewed in an axial direction of the screen printing forme.

10. The security printing press according to claim 1, wherein the inking aid is configured as a flap.

11. A method for operating a squeegee device in a security printing press, for printing on a sheet-type printing substrate using a screen printing method, including;

providing at least at one printing point in a printing unit contained in a printing assembly;

including one or more drying units in the printing press and on a printing substrate path disposed downstream of the printing assembly;

providing a squeegee which is thrown onto and off of a screen printing forme in a recurring cycle comprising a sequence of one or more phases (PON) relating to a thrown-on position "ON" and one or more phases (POFF) relating to a thrown-off position ("OFF");

correlating one of the length and the position of the cycle to one of a press phase length and a printing substrate phase length and a phase position;

throwing the squeegee on and off according to a sequence depending on one of a current printing substrate format and print image;

providing a squeegee drive device including a drive means that can be controlled by a control device and a cam mechanism, and by which squeegee drive device the throwing-on and throwing-off movement of the squeegee can be brought about mechanically independently of the one of the press phase position and the printing substrate phase position;

using the control device for driving the drive means of the squeegee drive device at an angular speed which one of is and can be varied over the course of a full revolution of the cam disk; and throwing on the squeegee in advance, within the sequence that is correlated to the one of the press phase position and the printing substrate phase length and phase position, such that the squeegee is disposed in its thrown-on position (ON) to form a bead of ink before a leading end of the printing substrate sheet enters a nip point that is formed at the printing point between screen printing forme and counter bearing.

12. The method according to claim 11, further including throwing the squeegee on and off within the cycle with one of varying phase lengths and phase positions, dependent on information I(F); I(LB); I(M) relating to one of the printing substrate format and the print image, and varying one of phase positions and phase lengths of the sequence dependent on information I(F); I(LB); I(M) relating to one of the printing substrate format and the print image, and varying one of the length and position and number of a phase (PON) relating to the thrown-on position ("ON") within a recurring sequence, the length and position of which recurring sequence are in a fixed correlation to one of the press phase position and the printing substrate phase position, depending on one of information I(F); I(LB); I(M) relating to the printing substrate format and the print image.

13. The method according to claim 11, further including, for a longer printing substrate format, as viewed in the transport direction of the printing substrate, placing the squeegee in the thrown-on position ("ON") for a greater phase length than for a shorter printing substrate format, and for a greater print image length viewed in the transport direction of the printing substrate, placing the squeegee in the thrown-on position ("ON") for a greater phase length than for a shorter print image length, and for a greater printing strip length, as viewed in the transport direction of the printing substrate, placing the squeegee in the thrown-on position ("ON") for a greater phase length than for a shorter printing strip length.

14. The method according to claim 11, further including, in the case of a plurality of printing strips to be applied over the same overall print image length (LB), spaced one in front of the other in the transport direction and interrupted in pairs by a strip that will not be printed on, throwing the squeegee on and off again multiple times based on the phase length that corresponds to the print image length (LB).

15. The method according to claim 11, further including throwing the squeegee on and off by using an electric motor.

* * * * *